US007118420B1

(12) United States Patent
Lai et al.

(10) Patent No.: US 7,118,420 B1
(45) Date of Patent: Oct. 10, 2006

(54) DUAL-SLOT CARD CONNECTOR CAPABLE OF AVOIDING ERRONEOUS INSERTION OF TWO CARDS AT ONCE

(75) Inventors: Yaw-Huey Lai, Taipei County (TW); Dong-Chu Feng, Huna Province (CN)

(73) Assignee: Tai-Sol Electronics Co., Ltd., Tapei (TW)

( * ) Notice: Subject to any disclaimer, the term of this patent is extended or adjusted under 35 U.S.C. 154(b) by 0 days.

(21) Appl. No.: 11/407,953

(22) Filed: Apr. 21, 2006

(51) Int. Cl.
*H01R 24/00* (2006.01)

(52) U.S. Cl. ..... 439/630; 439/946

(58) Field of Classification Search ..... 439/630, 439/631, 946
See application file for complete search history.

(56) References Cited

U.S. PATENT DOCUMENTS 6,900,982 B1 * 5/2005 Chang et al. ..... 361/685
6,908,321 B1 6/2005 Lai
6,974,350 B1 * 12/2005 Chen ..... 439/630
7,048,588 B1 * 5/2006 Chang ..... 439/630
2006/0079132 A1 * 4/2006 Ko ..... 439/630

* cited by examiner

*Primary Examiner*—Hae Moon Hyeon
(74) *Attorney, Agent, or Firm*—Bacon & Thomas

(57) ABSTRACT

A dual-slot card connector includes a flat base having a first insertion slot and a second insertion slots partly overlapping and communicating with each other for receiving different cards, and a pair of the receiving grooves and a pair of the first retaining portions; a movable plate mounted to the overlap of the first and second insertion slots and movably mounted in the receiving grooves and having a main body, a pair of receiving portions mounted to bilateral sides of the main body, a pair of second retaining portions in connection with the first retaining portions, and a plurality of terminal tunnels formed on the main body; a pair of springy strips mounted on the base and contacting against the movable plate; a cover shell covered on the base; and a plurality of contact terminals mounted on the base and partly received in the terminal tunnels.

9 Claims, 8 Drawing Sheets

DUAL-SLOT CARD CONNECTOR CAPABLE OF AVOIDING ERRONEOUS INSERTION OF TWO CARDS AT ONCE

BACKGROUND OF THE INVENTION

1. Field of the Invention

The present invention relates generally to all-in-one card connectors, and more particularly, to a dual-slot card connector capable of avoiding erroneous insertion of two cards at once.

2. Description of the Related Art

Most of the current card connectors are structurally all-in-one, having multiple receiving chambers and terminals for accommodating and electrical connection with a variety of electronic cards, such as memory stick (MS) cards, smart media (SM) cards, multimedia cards (MMC), secure digital (SD) card, and extreme digital (XD) cards.

In some of the conventional all-in-one card connectors, no mutual interference is incurred while some cards are inserted into the same card connector at the same time. It indicates that the user can insert two kinds of cards into the card connector at the same time; namely, while one card has been inserted into the card connector, another card will not fail to be inserted into the same. However, under such circumstance, if the user accidentally inserts two cards into the card connector at once while the card connector is working, reading or writing errors may happen and even the whole card connector may malfunction or be damaged.

To overcome the above problem, the inventor used to invent an all-in-one single-slot card connector compatible with a variety of cards and such invention was granted as U.S. Pat. No. 6,908,321 This all-in-one single-slot card connector includes a base, two plate members, and a plurality of contact terminals. The base has an insertion slot, two lateral sections formed at bilateral sides of the insertion slot thereof, a guide groove formed at one of the two lateral sections, a movable guide member movably mounted in the guide groove for vertical movement forced externally, a springy member mounted between the movable guide member and the base for generating resilience keeping the movable guide member moving toward a given direction. The two plate members are mounted closely to the base. The contact terminals are mounted to the two plate members, each having a body portion extending through the opening for electrical connection with contact pads of an electronic card. In light of this, the movable guide member allows the card to pass therethrough and be pushed towards a direction by the card to stop insertion of another card while the card is inserted.

However, it is difficult to reduce the size of the whole card connector and for development of miniaturization of electronic devices because the movable guide member of that all-in-one card connector is mounted at bilateral sides inside the insertion slot for stopping insertion of another card only.

SUMMARY OF THE INVENTION

The primary objective of the present invention is to provide a dual-slot card connector capable of avoiding erroneous insertion of two cards at once, which size is greatly reduced to facilitate further development of miniaturization of the electronic devices.

The foregoing objectives of the present invention are attained by the dual-slot card connector composed of a flat base, a movable plate, a pair of springy strips, a cover shell, and a plurality of groups of contact terminals. The base includes a first insertion slot, a second insertion slot, a pair of receiving grooves, and a pair of first retaining portions. The first and second insertion slots are formed therein for receiving different cards, partly overlapping each other and thus communicating with each other. Each pair of the receiving portions and the first retaining portions are formed at bilateral sides of the first insertion slot of the base. The movable plate is mounted to the overlap of the first and second insertion slots and movably mounted in the receiving groove. The movable plate includes a main body, a pair of receiving portions mounted to bilateral sides of the main body, a pair of second retaining portions connected with the first retaining portions, and a plurality of terminal tunnels formed on the main body. The springy strips are mounted on the base, contacting against the movable plate. The cover shell is covered on the base. The contact terminals are mounted on the base and some groups of the same are received in the terminal tunnels of the movable plate.

Further, the first insertion slot is shorter than the second insertion slot to enable the base to define a shoulder portion and two arm portions located at bilateral sides of the shoulder portion, wherein the two arm portions opposite to bilateral sides of the first insertion slot are defined as the receiving grooves and the first retaining portions respectively.

Further, each of the first retaining portions has a pair of retaining guide recesses. Each of the second retaining portions has a pair of retaining guide pins and a pair of retaining lugs. The retaining guide pins are mounted to bilateral sides of the main body of the movable plate respectively to be movably installed in one pair of the retaining guide recesses respectively. The retaining lugs are mounted to the receiving portions and located away from the retaining guide pins to be movably installed in the other pair of the retaining guide recesses.

Further, the terminal tunnels are formed on the shoulder portion of the base for receiving the contact terminals.

Further, a pair of strip-fixing holes are formed on the shoulder portion and located at an end surface thereof opposite to the first insertion slot for fixing the springy strips.

Further, a pair of strip-receiving grooves are formed on the main body of the movable plate for receiving the springy strips.

Further, the main body of the movable plate has a plurality of ridges formed thereon for accommodating an inserted card.

Further, the main body of the movable plate has a buffer member mounted in front of the contact terminals. The cover shell is U-shaped in section.

DETAILED DESCRIPTION OF PREFERRED EMBODIMENTS

Figure 1:
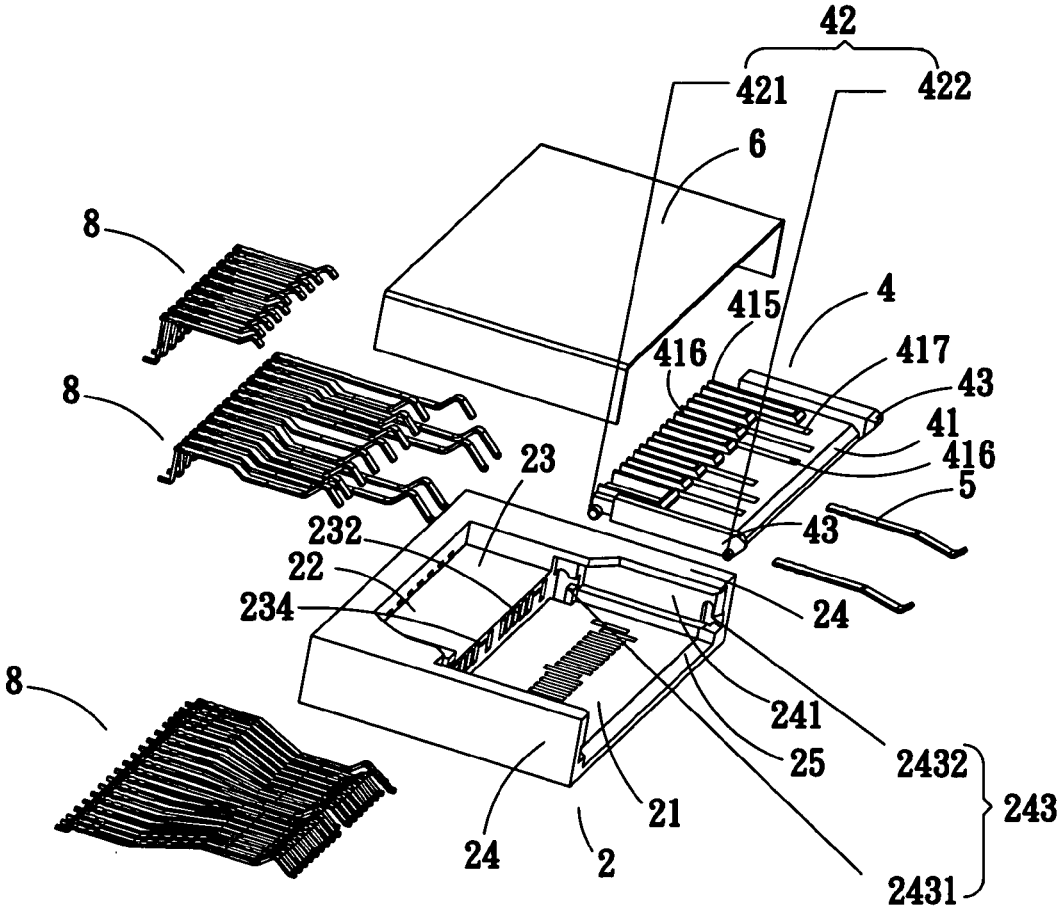
FIG. 1 is an exploded view of a preferred embodiment of the present invention.
Figure 2:
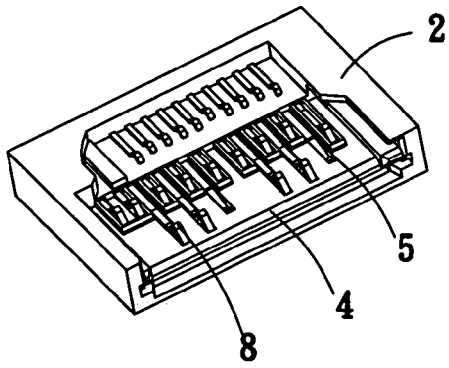
FIG. 2 is a perspective view of a part of the preferred embodiment of the present invention.
Figure 3:
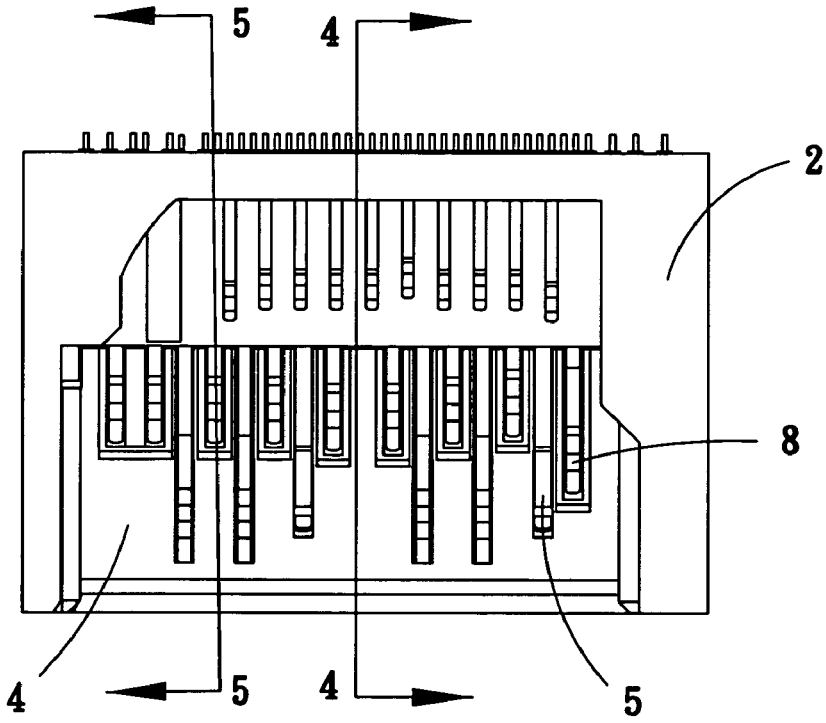
FIG. 3 is a top view of FIG. 2.
Figure 4:
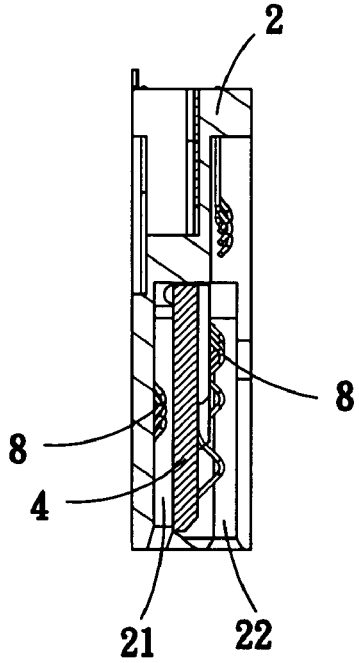
FIG. 4 is a sectional view taken from a line 4—4 indicated in FIG. 3.
Figure 5:
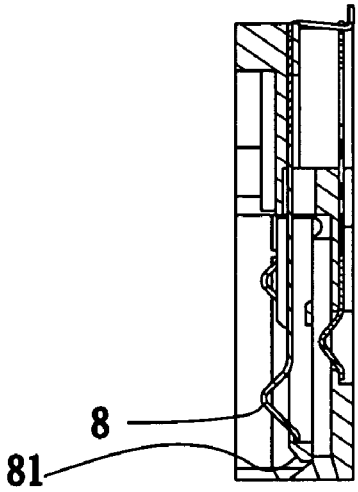
FIG. 5 is a sectional view taken from a line 5—5 indicated in FIG. 3.
Figure 6:
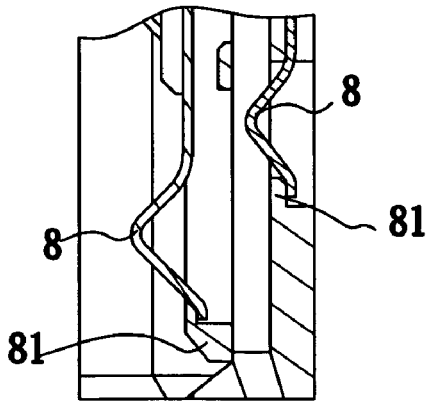
FIG. 6 is an enlarged view of a part of FIG. 5.

Referring to FIGS. 1–6, a dual-slot card connector capable of avoiding erroneous insertion of two cards at once is composed of a flat base 2, a movable plate 4, a pair of springy strips 5, a cover shell 6, and a plurality of groups of contact terminals 8.

The base 2 includes a first insertion slot 21 and a second insertion slot 22 for receiving/inserting different cards. In this embodiment, the first insertion slot 21 can accommodate an XD card, and the second insertion slot 22 can accommodate an MS card, an SD card, and an MMC card. The first and second insertion slots 21 and 22 partially overlap each other and communicate with each other. The second insertion slot 22 is longer, higher, and less wide than the first insertion slot 21 to define a shoulder portion 23 and a pair of arm portions 24 located at bilateral sides of the shoulder portion 23. The shoulder portion 23 has a plurality of terminal tunnels for receiving the contact terminals 8, and a pair of strip-fixing holes 234 formed on an end surface thereof opposite to the first insertion slot 21. The two arm portions 24 has a pair of receiving grooves 241 and a pair of first retaining portions 243 formed at bilateral sides thereof opposite to the first insertion slot 21.

The movable plate 4 is mounted to the overlap of the first and second insertion slots 21 and 22 and installed in the receiving grooves 241, thus reducing the thickness of the base 2 to further reduce the size of the whole card connector. The movable plate 4 includes a main body 41, a pair of receiving portions 43 mounted to bilateral sides of the main body 41, and a pair of second retaining portions 42 movably connected with the first retaining portions 243 respectively. The first retaining portions 243 each have a first guide recess 2431 and a second retaining guide recess 2432. The second retaining portion 42 has a pair of retaining guide pins 421 and a pair of retaining lugs 422. The two retaining guide pins 421 are mounted on the two lateral sides of the main body 41 to be movably installed in the first retaining guide recesses 2431. The two retaining lugs 422 are mounted to the receiving portions 43 and located away from the retaining guide pins 421 to be movably installed in the second retaining guide recesses 2432. The main body 41 further has a plurality of ridges 415 for accommodating the insertion of an electronic card (not shown), a plurality of terminal grooves 416 for receiving the contact terminals 8, and a pair of strip-receiving grooves 417 for receiving the springy strips 5. A buffer member 81 is mounted to each of the terminal tunnels and grooves 232 and 416 and located close to each of two ends thereof for avoiding damage thereto incurred by the impingement of the card erroneously inserted.

The cover shell 6 is U-shaped in section and is formed of a metallic bended sheet. The cover shell 6 can be made of alternative material.

In assembly, the contact terminals 8 are mounted on the base 2, the movable plate 4 abutting the shoulder portion 23 is movably installed in the receiving groove 241 of the arm portions 24, and the terminal grooves 416 receive the contact terminals 8. Each of the springy strips 5 has two ends fixed to the strip-fixing hole 234 and contacting against the strip-receiving groove 417 respectively. Under none of any external force, the resilience of the springy strip 5 can keep the movable plate 4 to move toward the first insertion slot 21. The cover shell 6 is covered on the base 2.

Figure 7:
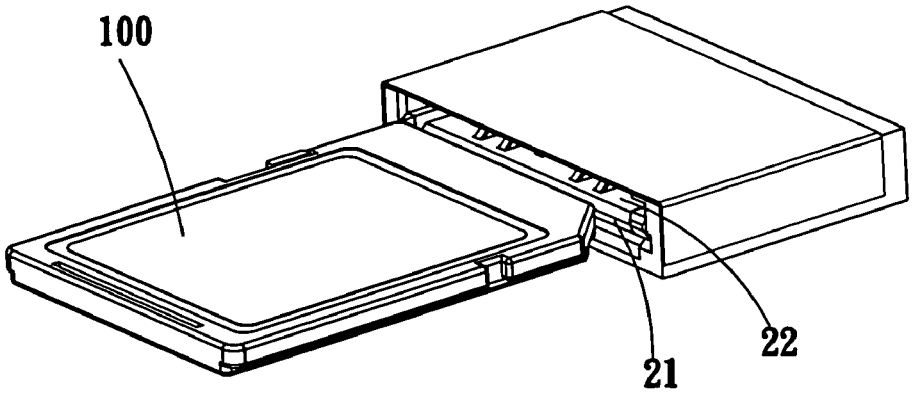
FIG. 7 is a perspective view of the preferred embodiment of the present invention that an SD card is being inserted.
Figure 8:
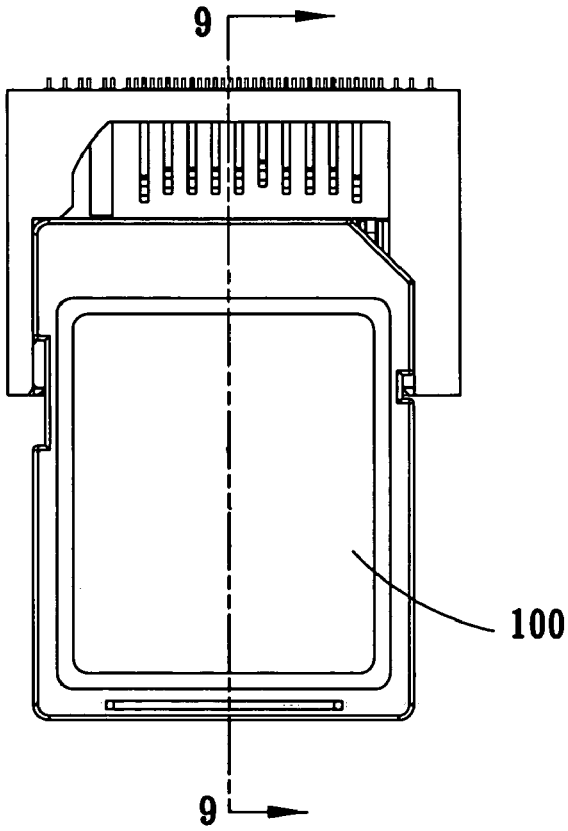
FIG. 8 is a schematic view of the preferred embodiment of the present invention that the SD card is being inserted.
Figure 9:
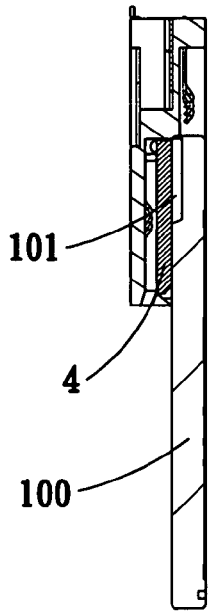
FIG. 9 is a sectional view taken from a line 9—9 indicated in FIG. 8.

In operation, referring to FIGS. 7–9, while an SD card having a plurality of insulated strips 101 disposed between contact pads thereof is correctly inserted into the card connector, the first insertion slot 21 is lower than the second insertion slot 22 such that the SD card 100 can be inserted into the second insertion slot 22 only. While the insulated plate 101 of the SD card 100 contacts against the ridges 415, the SD card can successfully fully enter the second insertion slot 22. In the meantime, the movable plate 4 is located in the first insertion slot 21 to disable any insertion of another card into the first insertion slot 21, thus enabling the multiple-slot card connector to receive one card only at once. While a card is incorrectly inserted, e.g. an SD card is inserted with its bottom side facing upward and its front end facing forward, or with its bottom side facing upward and its rear end facing forward, or with its top side facing upward and its rear end facing forward, the card stops moving forward at the ridges 415 and thus does not impinge and damage the contact terminals 8.

Figure 10:
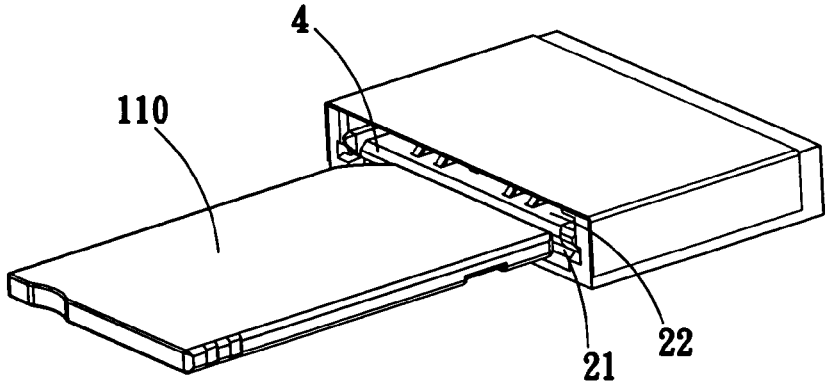
FIG. 10 is a perspective view of the preferred embodiment of the present invention that an MS card is being inserted.
Figure 11:
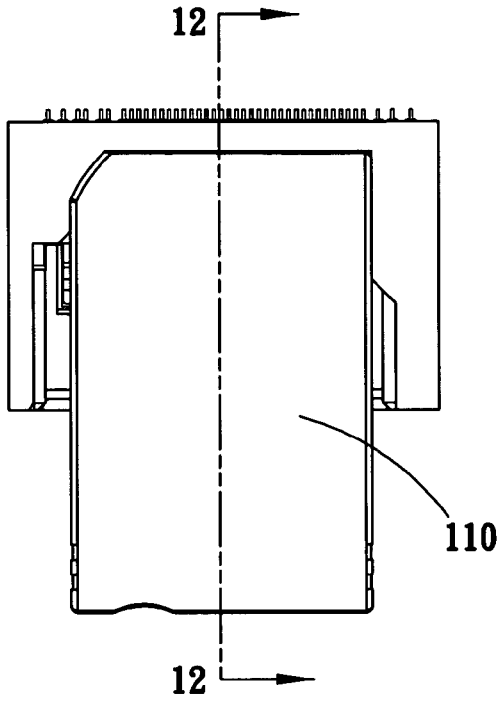
FIG. 11 is a schematic view of the preferred embodiment of the present invention that the MS card is inserted.
Figure 12:
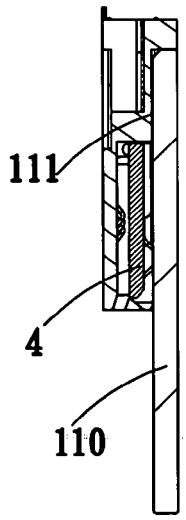
FIG. 12 is a sectional view taken from a line 12—12 indicated in FIG. 11.

As indicated above, referring to FIGS. 10–12, while an MS card 110 is correctly inserted, the first insertion slot 21 is lower than the second insertion slot 22 such that the MS card 110 can be inserted into the second insertion slot 22 only. Because the MS card 110 has a front end that is higher than the ridges 415 and provided with a bevel 111 formed at a lower side thereof, the front end of the MS card 110 while inserted can directly pass over the ridges 415 to enable the MS card 110 to fully enter the second insertion slot 22. In the meantime, the movable plate 4 is located in the first insertion slot 21 to disable any insertion of another card into the first insertion slot 21, thus enabling the multiple-slot card connector to receive one card only at once. The status of the erroneous insertion of the MS card is the same as that of the SD card, such that no further recitation is necessary.

Figure 13:
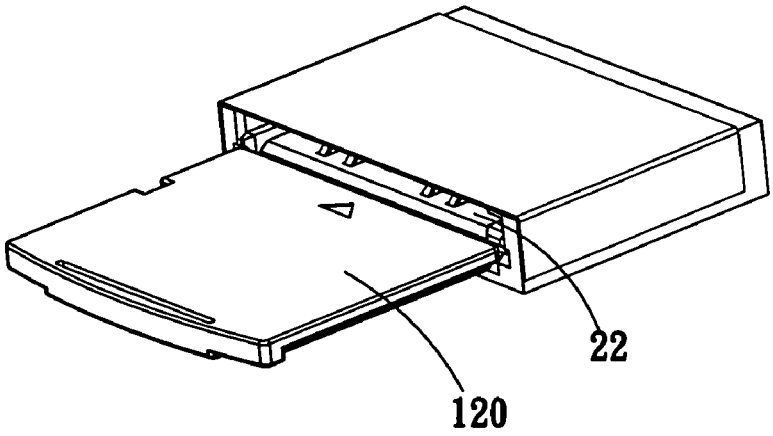
FIG. 13 is a perspective view of the preferred embodiment of the present invention that an XD card is being inserted.
Figure 14:
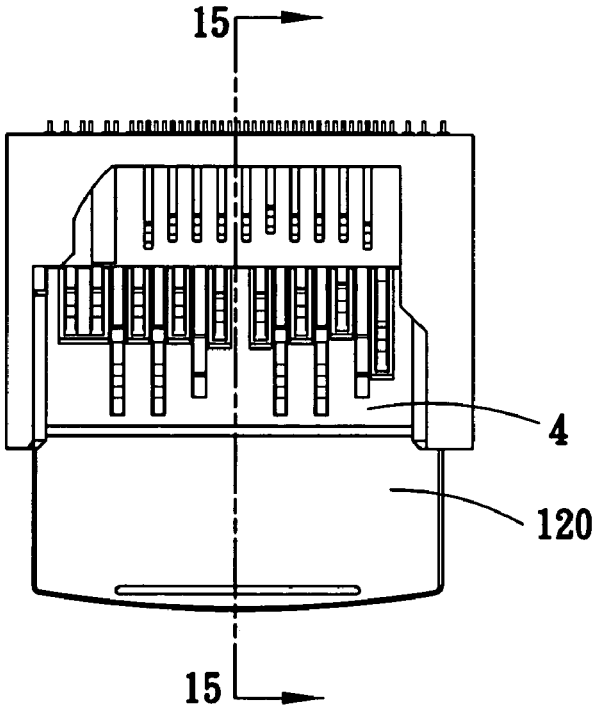
FIG. 14 is a schematic view of the preferred embodiment of the present invention that the XD card is inserted.
Figure 15:
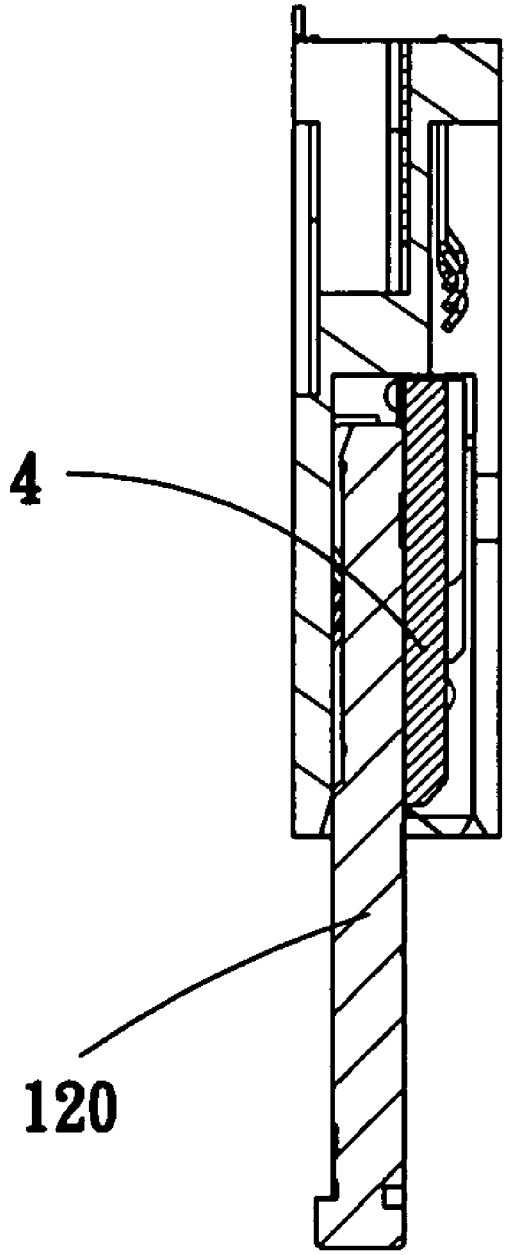
FIG. 15 is a sectional view taken from a line 15—15 indicated in FIG. 14.

Referring to FIGS. 13–15, while an XD card 120 is correctly inserted, the XD card 120 can be inserted into the first insertion slot 21 only because the second insertion slot 22 is narrower than the first insertion slot 21. In the meantime, the movable plate 4 is pushed by the XD card 120 to move toward the second insertion slot 22 to further disable any insertion of another card into the first insertion slot 22, thus enabling the multiple-slot card connector to receive one card only at once. In addition, the buffer members 81 are located in front of the contact terminals 8 to protect the contact terminals 8 from damage caused by the impingement of the card.

In conclusion, the movable plate is provided with the terminal grooves and the movable plate is mounted close to the front end of the base such that the base can be shortened. The movable plate is mounted to the overlap of the first and second insertion slots to reduce the thickness of the base and to reduce the size of the card connector, thus helping the development of miniaturization of the card connector.

What is claimed is:

1. A dual-slot card connector capable of avoiding erroneous insertion of two cards at once, comprising:

a flat base having a first insertion slot and a second insertion slot for receiving different electronic cards respectively, said first and second insertion slots partially overlapping each other and communicating with each other, said base having a pair of receiving grooves and a pair of first retaining portions, each pair of which are located at bilateral sides of said first insertion slot respectively;

a movable plate mounted to the overlap of said first and second insertion slots and movably installed in said receiving grooves, said movable plate having a main body, a pair of receiving portions formed at bilateral sides of said main body, a pair of second retaining portions in connection with said first retaining portions respectively, and a plurality of terminal grooves formed on said main body;

a pair of springy strips mounted to said base and contacting against said movable plate;

a cover shell covered on said base; and a plurality of contact terminals mounted on said base, wherein parts of said contact terminals are received in said terminal grooves of said movable plate.

2. The dual-slot card connector as defined in claim 1, wherein said first insertion slot is shorter than said second insertion slot to enable said base to define a shoulder portion and a pair of arm portions formed at bilateral sides of said shoulder portion, each pair of said receiving grooves and said first retaining portions being located at said arm portions respectively.

3. The dual-slot card connector as defined in claim 2, wherein said first retaining portions of said base each have a pair of retaining guide recesses; said second retaining portions of said movable plate each have a retaining guide pin and a retaining lug, said retaining guide pins being mounted to bilateral sides of said main body respectively and movably installed in one pair of said retaining guide recesses respectively, said retaining lugs being mounted to said receiving portions away from said retaining guide pins and movably installed in the other pair of said retaining guide recesses.

4. The dual-slot card connector as defined in claim 2, wherein said shoulder portion of said base has a plurality of terminal tunnels for receiving said contact terminals.

5. The dual-slot card connector as defined in claim 2, wherein said shoulder portion of said base has a pair of strip-fixing holes formed on an end surface thereof opposite to said first insertion slot for fixing said springy strips.

6. The dual-slot card connector as defined in claim 1, wherein said main body of said movable plate has a pair of strip-receiving grooves for receiving said springy strips.

7. The dual-slot card connector as defined in claim 1, wherein said main body of said movable plate has a plurality of ridges for accommodating insertion of an electronic card.

8. The dual-slot card connector as defined in claim 1, wherein said base further has a plurality of buffer members mounted in front of said contact terminals.

9. The dual-slot card connector as defined in claim 1, wherein said cover shell is U-shaped in section.

* * * * *